108-98 AU 113 EX
1/15/80 XR 4,183,188

United States Patent [19]
Goldsby

[11] 4,183,188
[45] Jan. 15, 1980

[54] SIMULATED BRICK PANEL, COMPOSITION AND METHOD

[76] Inventor: Claude W. Goldsby, 7660 O'Neal Rd., Salem, Oreg. 97303

[21] Appl. No.: 814,914

[22] Filed: Jul. 12, 1977

[51] Int. Cl.[2] ..... E04B 5/04
[52] U.S. Cl. ..... 52/596; 52/600; 106/96

[58] Field of Search ..... 52/600, 601, 670, 596, 52/309.17, 612, 309.12, 368, 376; 106/96, 103

[56] References Cited

U.S. PATENT DOCUMENTS

| | | | |
|---|---|---|---|
| 2,184,353 | 12/1939 | Leary | 52/670 X |
| 2,252,980 | 8/1941 | Rhett | 52/368 |
| 2,324,916 | 7/1943 | Duncan et al. | 52/600 X |
| 3,145,502 | 8/1964 | Rubenstein | 52/596 X |

*Primary Examiner*—Carl D. Friedman
*Attorney, Agent, or Firm*—Francis Swanson

[57] ABSTRACT

A simulated brick panel and the method of making it are disclosed. The panel has double expanded metal reinforcement and is very light in weight compared to similar articles of conventional brick and mortar construction. The panel is ductile and may be mounted on a wall merely by nailing directly through the panel. The composition of the mixture from which the panels are cast is also disclosed.

2 Claims, 6 Drawing Figures

FIG. 1
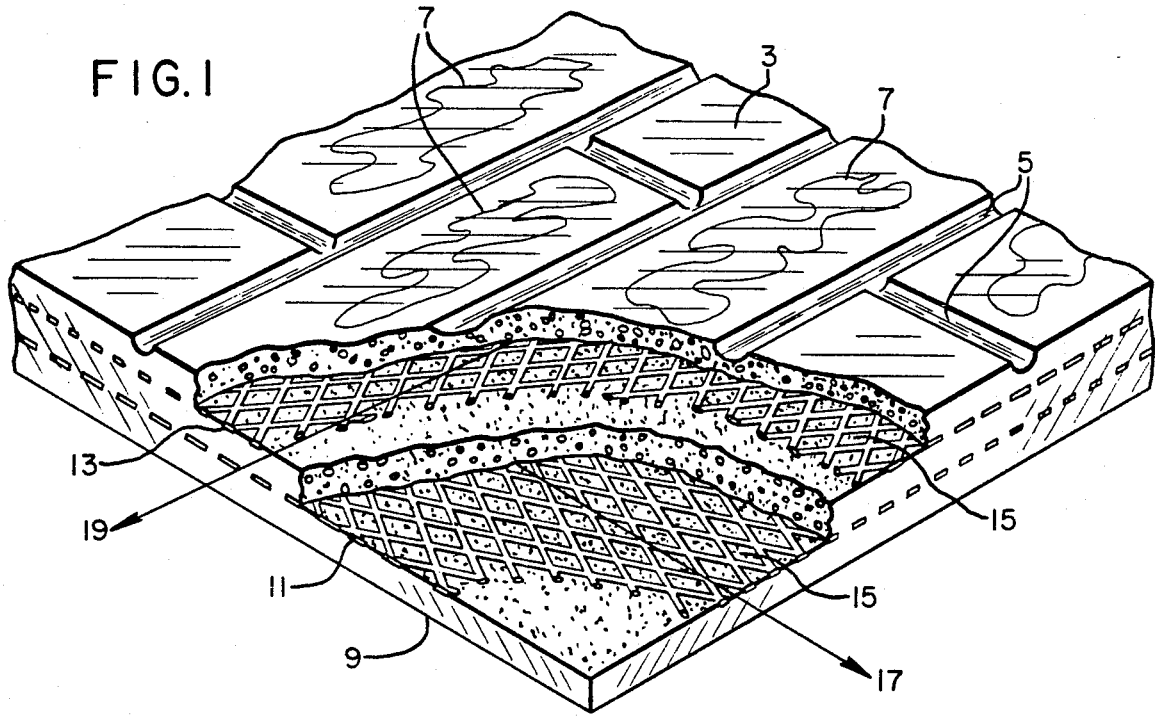
FIG. 2
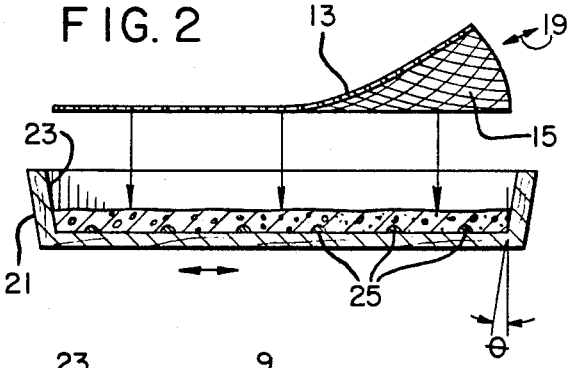
FIG. 3
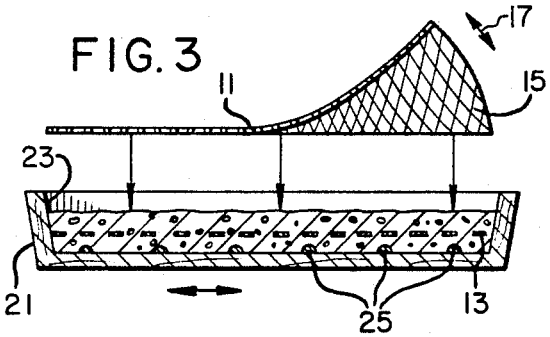
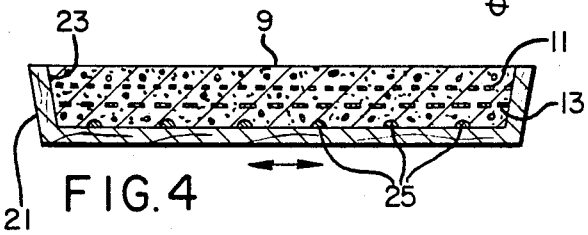
FIG. 4
FIG. 5
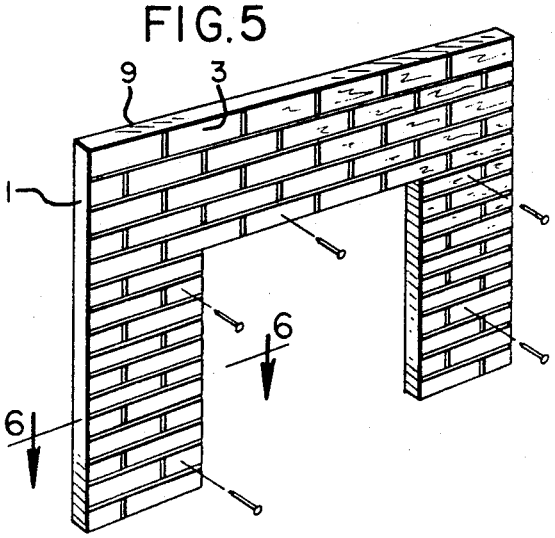
FIG. 6
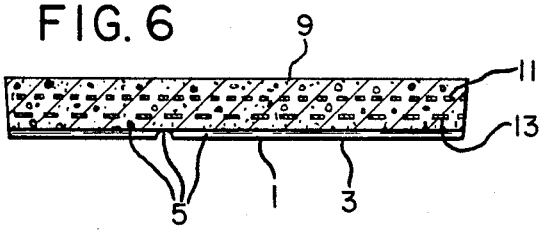

SIMULATED BRICK PANEL, COMPOSITION AND METHOD

BACKGROUND OF THE INVENTION

1. Field of the Invention

This invention relates to decorative building panels in general and more particularly to those which resemble brick.

2. Description of the Prior Art

It is known in the prior art to make decorative panels which represent brick or stone.

One such technique is disclosed in U.S. Pat. No. 3,836,619 wherein artificial stones are made of a molding process. Another method of making simulated brick panels is disclosed in U.S. Pat. No. 3,795,721 wherein sections intended for mounting on walls are cast in a mold. This panel has a mortar line groove and special mounting cavities for fasteners.

Most artificial panels have the disadvantages of relatively high weight and poor insulating properties. They are susceptible to fracture if dropped or struck and they lack ductility in that slight bending stresses induce cracking. As used herein ductility means the ability to withstand deformation under load without fracture.

SUMMARY OF THE INVENTION

It is a principal object of the invention to produce a panel having superior ductility and high resistance to fracture.

It is a further object of the invention to produce a panel which is relatively light in weight and which has good insulating properties.

A further object is to produce a panel which may be nailed to a vertical surface by driving nails directly through the panel without providing nail holes or special fastening grooves and without fracturing the panel.

A further object of this invention is to produce a panel having a plurality of metal reinforcement members molded within the panel.

A further object of the invention is to provide a method of making artificial brick panels which permits wide variation in surface appearance and color in a completely controllable manner.

A still further object of the invention is to provide a method for making artificial brick panels which allows rapid cure to shipping strengths, usually 48 to 72 hours.

It is a still further object of the invention to provide a composition of ingredients which when molded into a panel together with expanded metal reinforcing members will yield a panel with the desirable properties described above.

Other objects and advantages will be apparent to those skilled in the art to which the invention pertains.

BRIEF DESCRIPTION OF THE DRAWINGS

FIG. 1 is a perspective view of one corner of a typical panel broken away to show the details of construction and the relative relation to the two metal reinforcing layers.

FIG. 2 is a cross-section through the mold showing the first pouring of material and the insertion of the first reinforcement member.

FIG. 3 is a cross-section through the mold showing the second pouring of material and the insertion of the second reinforcement member.

FIG. 4 is a cross-section through the mold showing the completed panel casting.

FIG. 5 shows a typical finished panel for use around a fireplace.

FIG. 6 is a section taken along line 6—6 of FIG. 5.

BRIEF DESCRIPTION OF THE DRAWINGS

Composition of the Casting Mixture

The cast panels are made by pouring a wet mixture into a mold. The composition of the mixture together with the construction of the panel described within gives the unique properties of nailability, fracture resistance, light weight and good insulation properties. This novel composition comprises a mixture of portland cement, aggregate in the form of pumice, water, and a pure petroleum jelly additive. The combination of the pumice and petroleum jelly, when present in the proper ratios, as illustrated below, produces the ductility and nailability without fracture which is exhibited by the panels. An example of this petroleum jelly additive is known and marketed under the trademark NEWCRETE, a product of the Gehenco Company of Bakersfield, Calif.

EXAMPLE

A typical batch of mixture suitable for pouring panels is made as follows:

- 9–1200 lbs. (0.9–1.1 cubic yards) of aggregate; for example, pumice (52–64% by weight)
- 450–500 lbs. portland cement, type 1 or 2 (23–31% by weight)
- 2–300 lbs. of water, completely free of sulfates (10–18% by wt.)
- ½–3 lbs. of NEWCRETE additive (0.016–0.18% by weight)

Great care must be taken during preparation of the mixture to assure adequate dispersal of the petroleum jelly additive.

The mixture is begun by adding the petroleum jelly to the water and vigorously mixing the same for several minutes. The portland cement is then added together with any optional coloring dyes. The mixture is again churned for several minutes. The aggregate is added slowly to assure a smooth mix. Churning is continued for fifteen to thirty minutes. At all times the mixture must be maintained at a temperature above 60° Fahrenheit. After the final churning the mixture is ready to pour into the mold.

Construction of the Panel

Referring now to the drawings, FIG. 1 shows the details of construction of a typical panel molded to resemble brick. The panel (1) has an outer face (3) into which are molded a plurality of grooves (5) which give the panel the appearance of brick. If desired, decorative color blotches (7) can be molded into panel (1) which will give the appearance of used brick. The method of producing blotches (7) is described below under the description of the Molding of the Panel. The panel (1) has a rear surface (9) intended to fit against a mounting surface such as a wall or floor. Unlike many other artificial brick moldings, panel (1) does not require precast nail holes or fastener grooves. However, it is readily seen that these could be cast in if desired.

Between outer face (1) and rear surface (9) are two steel reinforcing members (11) and (13). These members are made of expanded metal which typically has elongate diamond-shaped openings (15).

These diamond-shaped openings in a sheet of expanded metal give it anisotropic bending properties. For instance, it is much easier to bend a sheet of expanded metal about an axis parallel to the long axis of the diamong-shaped openings than about an axis normal to the long axis of the openings. Collectively the individual long axes of the diamond-shaped openings from an axis of relative ridigity in a sheet of expanded metal. Solely for the purpose of illustration of the invention, these axes will be referred to individually as rigid axis (17) in reinforcing member (11) and as rigid axis (19) in reinforcing member (13).

It is seen from FIG. (1) that reinforcing member (11) is molded into panel (1) near rear surface (9) while reinforcing member (13) is molded in near outer face (3).

It is of the greatest importance that members (11) and (13) be molded into panel (1) with rigid axis (17) and (19) running substantially normal to one another in parallel planes as shown in FIG. 1.

Method of Molding the Panel

FIGS. 2, 3, and 4 illustrate the method of molding the panel.

A mold (21) defining a cavity (23) and having therein raised members (25) for producing a desired pattern in the panel is coated with a lubricant of animal or vegetable oil. Petroleum-based products must not be used because of a strong reaction which comes about between them and the petroleum jelly additive. The mold cavity (23) is then treated with a parting agent and left to dry for several hours before pouring. If color blotches (7) as shown in FIG. 1 are desired, cavity (23) is lightly coated with gypsum, silica, and/or black iron oxide dye and portland cement in the desired pattern.

The cavity is then partly filled with the molding mixture. Reinforcing member (13) is then placed on the wet surface and worked into the mixture. Further wet material is added to fill mold (21) about two-thirds full. Reinforcing member (11) is then added. Care is taken to insure the rigid axes (17) and (19) run normal to one another in parallel planes within mold (21). The upper surface of the wet material, which will form inner surface (9) of the finished panel, is smoothed off and the mold (21) is vibrated to produce a solid casting. The panel is ready for curing.

Curing the Panel

Curing may be accomplished merely by allowing the cast panel to dry in air at a temperature above 60° F. for several days or it may be forced. This is accomplished by placing the panel in an air-tight container such as a kiln and heating it to a temperature not exceeding 190° for 48 hours. After this time heat is shut off and the panel is allowed to cool to room temperature. The molds may then be removed and the panels freely handled.

Having described herein what is considered the preferred embodiments of my composition, method and panel, it will be obvious to those skilled in the art that modifications and changes may be made therein without departing from the true scope and spirit of the invention.

It is to be understood that the exemplary embodiments contained herein are illustrative and not restrictive. The scope of the invention is defined in the appended claims. All modifications that come within the meaning and range of equivalency of these claims are intended to be included therein.

I claim:

1. A decorative fracture resistant building panel comprising:

a body having a front face and a rear surface;

a plurality of expanded metal reinforcement members in spaced-apart relation within the body, each member forming a separate and substantially continuous layer lying in a plane parallel to and between the front face and rear surface;

the body comprising a ductile cementaceous material including petroleum jelly a constituent thereof in the range of 0.016 to 0.18% and further including pumice as a constituent thereof in the range of 52 to 64%, so that by the presence of petroleum jelly and pumice in the recited ranges the body becomes ductile and resistant to cracking from nailing.

2. The panel of claim 1 wherein each expanded metal reinforcement member has an axis of rigidity defined by the sum of the long axes of a plurality of diamond-shaped openings in the member and wherein each member is positioned within the body so that its axis of rigidity is substantially normal to the axis of rigidity of at least one other member, and each member is spaced substantially apart from every other member within the body.

* * * * *